US007167670B2

(12) United States Patent
Obata et al.

(10) Patent No.: US 7,167,670 B2
(45) Date of Patent: Jan. 23, 2007

(54) ELECTRO-PHOTOGRAPHIC APPARATUS WITH A HEATING ROLLER AND PRESSURIZING MEMBER

(75) Inventors: Shigeru Obata, Ibaraki (JP); Shunichi Oohara, Ibaraki (JP); Toshio Ogiso, Ibaraki (JP); Kenji Asuwa, Ibaraki (JP); Toru Hanashima, Ibaraki (JP); Chikara Hiraoka, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 0 days.

(21) Appl. No.: 11/127,146

(22) Filed: May 12, 2005

(65) Prior Publication Data

US 2005/0254866 A1 Nov. 17, 2005

(30) Foreign Application Priority Data

May 14, 2004 (JP) ..... P2004-144735

(51) Int. Cl.
*G03G 15/20* (2006.01)

(52) U.S. Cl. ..... 399/329; 399/328; 399/331; 219/216

(58) Field of Classification Search ..... 399/328, 399/329, 330, 331; 347/156; 219/216
See application file for complete search history.

(56) References Cited

U.S. PATENT DOCUMENTS

2004/0057759 A1* 3/2004 Ogiso et al. ..... 399/329
2005/0185996 A1* 8/2005 Oishi et al. ..... 399/329

FOREIGN PATENT DOCUMENTS

JP 2-24687 1/1990
JP 2004-29611 1/2004

* cited by examiner

*Primary Examiner*—David M. Gray
*Assistant Examiner*—Laura K. Roth
(74) *Attorney, Agent, or Firm*—McGinn IP Law Group, PLLC

(57) ABSTRACT

An electro-photographic apparatus for conducting printing includes a fixing member fixing an unfixed toner image on a surface of a recording medium onto the recording medium. The fixing member includes a heating roller and a pressurizing member, and a mounting member on which the pressurizing member is mounted. The pressurizing member is supported by the mounting member in a substantially center part in a longitudinal direction of the pressurizing member.

3 Claims, 3 Drawing Sheets

ELECTRO-PHOTOGRAPHIC APPARATUS WITH A HEATING ROLLER AND PRESSURIZING MEMBER

BACKGROUND OF THE INVENTION

1. Field of the Invention

The present invention relates to an electro-photographic apparatus employing an electro-photographic system.

2. Description of the Related Art

In an electro-photographic apparatus such as a laser printer or a copying machine, a structure including a heating roller and a pressurizing member as a fixing device for fixing an unfixed toner image on a recording medium such as paper or OHP has been known. Among the fixing devices of this type, there has been known the fixing device which is configured that three pressurizing members are provided relative to the endless belt for the purpose of prolonging heating and pressurizing time for the recording medium for attaining high-speed fixation (Refer to JP-A-2004-29611, for example).

According to the related art, the fixing device includes the heating roller having a heat source incorporated therein, the endless belt wound around the heating roller, and the three pressurizing members for pressurizing the endless belt into contact with the heating roller, wherein total pressure and peak pressure of one of the three pressurizing members at a second position from upstream in a conveying direction of the recording medium are set to be maximal.

However, there is no disclosure, in the related art, about condition of the pressure in a direction of a rotation axis of the heating roller, which would affect quality of picture or conveyance of the recording medium. There has been such a problem that in case where irregularity has occurred in pressurizing force of the pressurizing member influenced by variations in production, printing unevenness may occur, which may result in degradation of printing quality.

SUMMARY OF THE INVENTION

It is an object of the invention to provide an electro-photographic apparatus including a fixing device provided with a heating roller and a pressurizing member, wherein pressure to be applied to the heating roller is equalized along a longitudinal direction of the pressurizing member, thereby to obtain high printing grade having high picture quality.

According to one aspect of the invention, there is provided with an electro-photographic apparatus for conducting printing, the electro-photographic apparatus including: a fixing device fixing an unfixed toner image on a surface of a recording medium onto the recording medium, the fixing device including: a heating roller; a mounting member; a pressurizing member mounted on the mounting member; and an endless belt. The pressurizing member is substantially formed in a concave shape in a longitudinal direction of the pressurizing member. The mounting member has a projection in contact with the pressurizing member in a substantially center part in a longitudinal direction thereof. The electro-photographic apparatus is configured so that a pressure of the pressurizing member to be applied to the heating roller through the endless belt is substantially equalized by pressing the mounting member toward the heating roller while the pressurizing member is supported by the projection.

According to another aspect of the invention, there is provided with an electro-photographic apparatus for conducting printing, the electro-photographic apparatus including: a fixing device fixing an unfixed toner image on a surface of a recording medium onto the recording medium, the fixing device including: a heating roller; a mounting member; a pressurizing member mounted on the mounting member; and an endless belt. The pressurizing member is substantially formed in a concave shape in a longitudinal direction of the pressurizing member. The mounting member has a projection in contact with the pressurizing member in a substantially center part in a longitudinal direction thereof. The electro-photographic apparatus is configured so that a pressure of the pressurizing member to be applied to the heating roller through the endless belt is substantially equalized by pressing the mounting member toward the heating roller while the pressurizing member is supported by the projection.

According to another aspect of the invention, there is provided an electro-photographic apparatus for conducting printing, the electro-photographic apparatus including: a fixing device fixing an unfixed toner image on a surface of a recording medium onto the recording medium, the fixing device including: a heating roller; and a pressurizing member mounted on a mounting member. The pressurizing member includes an endless belt; a first, second and third pressurizing members that apply pressure to the heating roller through the endless belt; and a mounting member on which at least the second pressurizing member is mounted. The second pressurizing member is arranged between said first pressurizing member and said third pressurizing member along a conveying direction of the recording medium. The second pressurizing member has a concave shape in a longitudinal direction of the second pressurizing member. The pressurizing member has a projection in a substantially center part in a longitudinal direction of the mounting member. The electro-photographic apparatus is configured so that the pressure of said second pressurizing member to be applied to said heating roller through said endless belt is substantially equalized by pressing the mounting member toward the heating roller while the second pressurizing member is supported by the projection.

It is possible to provide the electro-photographic apparatus in which the pressure to be applied to the heating roller is equalized along the longitudinal direction of the pressurizing member, whereby high printing grade having high picture quality can be obtained.

DESCRIPTION OF THE PREFERRED EMBODIMENTS

Figure 1:
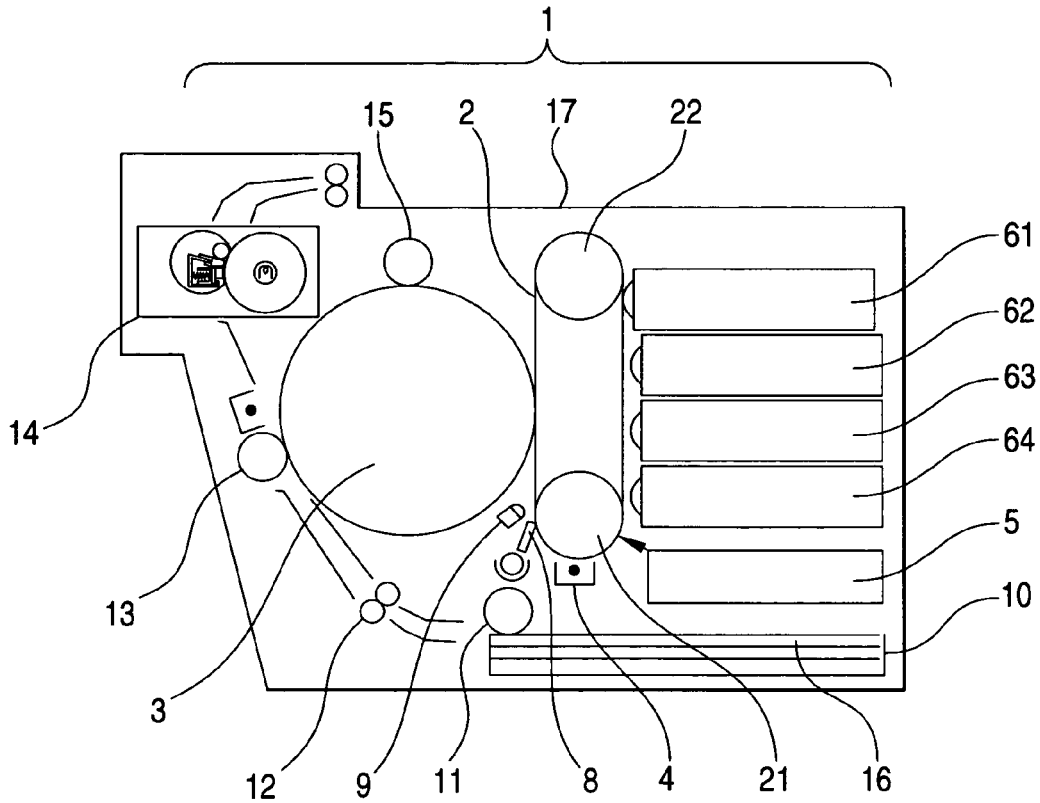
FIG. 1 is a sectional view schematically showing an electro-photographic apparatus in an embodiment according to the invention.

Now, an embodiment of the invention will be described, referring to the drawings.

FIG. 1 is a sectional view schematically showing a color laser printer, which is an electro-photographic apparatus to which the embodiment of the invention has been applied.

A printer 1 includes the following components. A photosensitive belt 2 is stretched in a direction perpendicular to the ground, by a driving roller 22 and a following roller 21 which functions also as a tension roller for applying tension to the photosensitive belt 2, and rotated at a constant speed. Around this photosensitive belt 2, there are provided an intermediate transfer body 3 which is disposed in contact with the photosensitive belt 2, an electrifying device 4 for uniformly electrifying a surface of the photosensitive belt 2, an exposing device 5 for exposing the surface of the photosensitive belt 2 which has been uniformly electrified, thereby to form an electrostatic latent image on the surface, four developing devices 61, 62, 63, 64 which are arranged so as to come into contact with a vertical face of the photosensitive belt 2, for developing the electrostatic latent image thereby to form a toner image, a blade 8 for removing toner which has remained on the surface of the photosensitive belt 2 after the toner image has been transferred, and an erase lamp 9 for erasing an electric load which has remained on the surface of the photosensitive belt 2 after the transfer of the toner image. Moreover, around the intermediate transfer body 3, there is provided a cleaner 15 for removing the toner which has remained on the surface of the intermediate transfer body 3. There are further provided, in a conveying path of paper, a cassette 10 for containing sheets of paper 16 which is a recording medium, a paper feeding roller 11 for feeding the paper from the cassette 10, a register roller 12 for correcting a posture of the paper 16 which has been fed from the cassette 10, a transfer roller 13 for transferring the toner image onto the paper 16, a fixing device 14 including a heating roller, a pressurizing member and an endless belt and adapted to fix the toner image which has been transferred onto the paper 16, and a paper discharging part 17 for receiving the paper 16 which has been fixed and then, discharged to the exterior of the printer.

Then, a method of forming a color image in the electrophotographic apparatus according to the invention will be described.

A print signal is transmitted from an information processing unit, which is not shown in the drawings, to a body of the printer 1 which has become ready for printing, after a power has been inputted. Then, according to the print signal, the exposing device 5 will irradiate a laser light on a surface of the photosensitive belt 2 which has been uniformly electrified by the electrifying device 4, whereby an electrostatic latent image is formed on the surface of the photosensitive belt 2.

As a first step, an electrostatic latent image corresponding to a toner image of yellow color is formed on the surface of the photosensitive belt 2 by the exposing device 5, and the toner image of the yellow color is developed by the developing device 61. In this embodiment, denoted with numeral 61 is a developing device in which the toner of yellow color is used, 62 is a developing device in which the toner of magenta color is used, 63 is a developing device in which the toner of cyanic color is used, and 64 is a developing device in which the toner of black color is used. Each of the developing devices is configured that developing function may be given to or removed from the developing device by controlling bias voltage. The toner image formed on the surface of the photosensitive belt 2 will be transferred onto the surface of the intermediate transfer body 3 at a contact point between the photosensitive belt 2 and the intermediate transfer body 3, and held there.

Meanwhile, after the toner image has been transferred, the toner which has not been transferred remains on the surface of the photosensitive belt 2. The remaining toner will be removed by the blade 8, and an electric load which remains on the surface of the photosensitive belt 2 will be erased by the erase lamp 9, whereby the surface of the photosensitive belt 2 will be returned to its initial state.

After the step of returning the surface of the photosensitive belt 2 to the initial state has been completed, a toner image of magenta color which is the next color is formed on the surface of the photosensitive belt 2 in the same manner, and superposed on the aforesaid toner image of yellow color which is held on the surface of the intermediate transfer body 3. The toner image thus superposed one on another will be transferred and held on the surface of the intermediate transfer body 3.

The same steps will be repeated for the cyanic and black colors, and the toner images of the four colors are superposed one on another and held on the surface of the intermediate transfer body 3.

In order to transfer the toner image of the four colors which has been formed on the surface of the intermediate transfer body 3 onto the paper 16, sheets of the paper 16 contained in the cassette 10 are separated one by one, by rotating the paper feeding roller 11. Then, the paper 16 is conveyed to the register roller 12, and stopped there, after a diagonal posture of the paper 16 has been corrected by the register roller 12. Thereafter, rotation of the register roller 12 is started in such timing as to come into registration with the toner image on the intermediate transfer body 3. Simultaneously when a leading end of the paper 16 thus conveyed has come into contact with the intermediate transfer body 3, the transfer roller 13 is pressed against a back face of the paper 16, thereby to electrostatically transfer the toner image of the four colors onto the surface of the intermediate transfer body 3 at once.

The toner image of the four colors thus completed on the paper 16 is passed between the heating roller and the endless belt which is pushed by the heating member in the fixing device 14, whereby the toner image will be fixed on the paper 16. Then, the paper 16 fixed with the toner image will be discharged to the paper discharging part 17.

Figure 2:
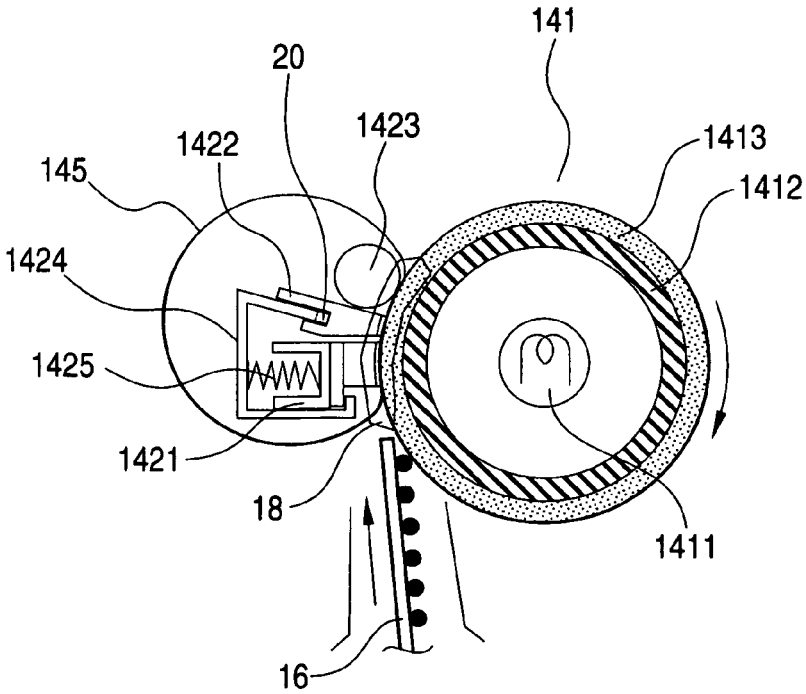
FIG. 2 is a view schematically showing a fixing device according to the embodiment of the invention.

Then, referring to FIG. 2, the fixing device 14 will be described in detail.

The fixing device 14 includes a heating roller 141 for melting the toner, a pressurizing member for applying pressure to the toner which has been melted by the heating roller 141 thereby to fix the toner to the paper 16, and an endless belt 145 which is brought into contact with the heating roller 141 to form a nip 18. The heating roller 141 has a heat source 1411 such as a halogen lamp, a core metal 1412, and a silicone rubber 1413 which covers a surface of the core metal 1412. The pressurizing member is provided with a pressurizing pad 1421 in the upstream in a conveying direction of the paper 16, a pressurizing pad 1422 in an intermediate area, a pressurizing roller 1423 in the downstream, and a stay 1424 on which the pressurizing pads 1421, 1422 are mounted. The pressurizing roller 1423 and the stay 1424 are pressed against the heating roller 141 respectively by resilient members such as springs, which are not shown. The pressurizing pad 1421 is mounted on the stay 1424 by several springs 1425 in a direction of a rotation axis of the heating roller 141. Further, the endless belt 145 which is formed of polyimide film or the like, is stretched in such a manner that no tension may be applied to the pressurizing pads 1421, 1422, and the pressurizing roller 1423. The endless belt 145 is pressed against the heating roller 141, and rotates synchronously with the heating roller 141.

When the paper 16 having the unfixed toner image transferred thereon passes a nip 18 which is formed by the pressurizing pads 1421, 1422, the pressurizing roller 1423, and the endless belt 145, the toner image will be fixed on the paper 16 under heat and pressure received from the pressurizing pads 1421, 1422, the pressurizing roller 1423, and the endless belt 145.

On this occasion, in case where the pressure of the pressurizing pads 1421, 1422, and the pressurizing roller 1423 in a direction of the rotation axis of the heating roller 141 has become irregular, degradation of picture quality due to difference in melting grade of the toner, and failure in conveyance of the paper 16 caused by wrinkles will occur.

In this embodiment, the pressure of the pressurizing pad 1422 in the direction of the rotation axis of the heating roller 141 is equalized, so that favorable printing quality can be obtained.

Figure 3:
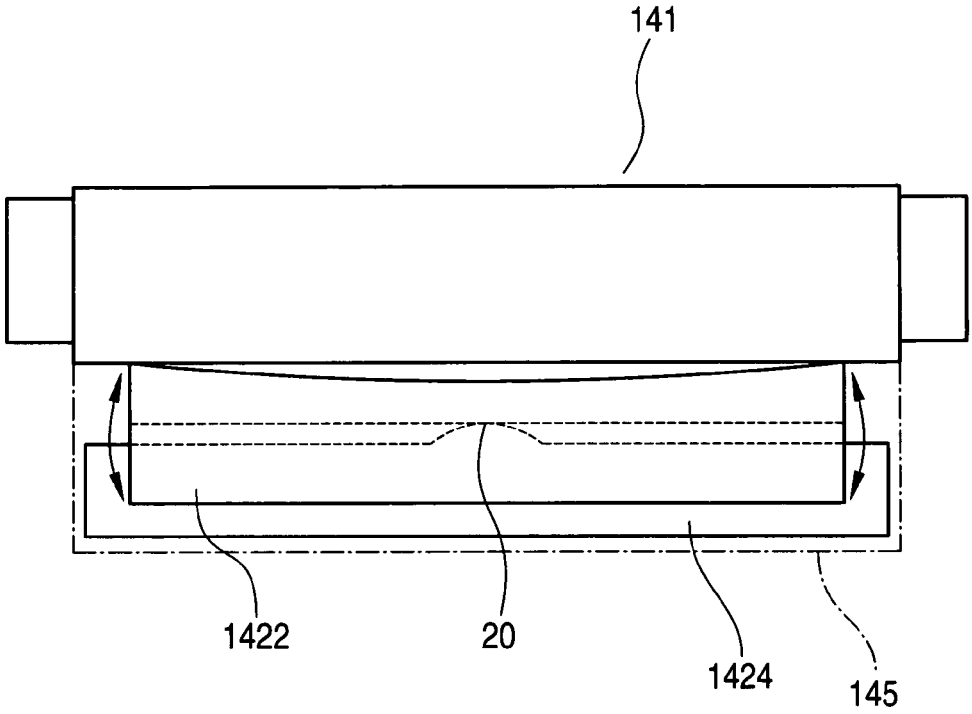
FIG. 3 is a view schematically showing the fixing device according to the embodiment of the invention before applying pressure.
Figure 4:
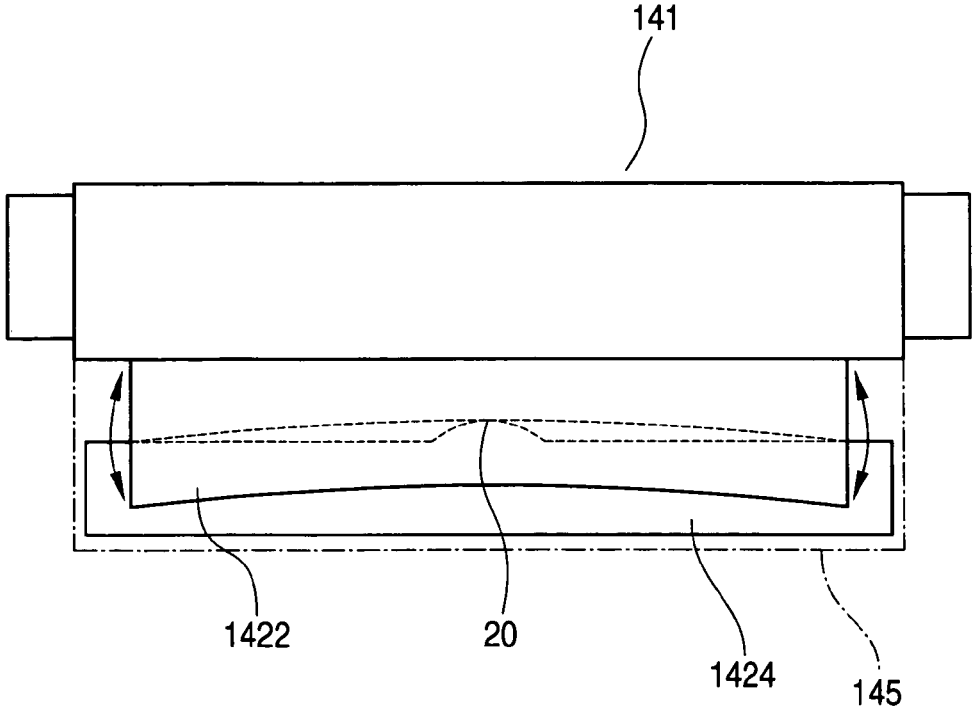
FIG. 4 is a view schematically showing the fixing device according to the embodiment of the invention after having applied the pressure.
Figure 5:
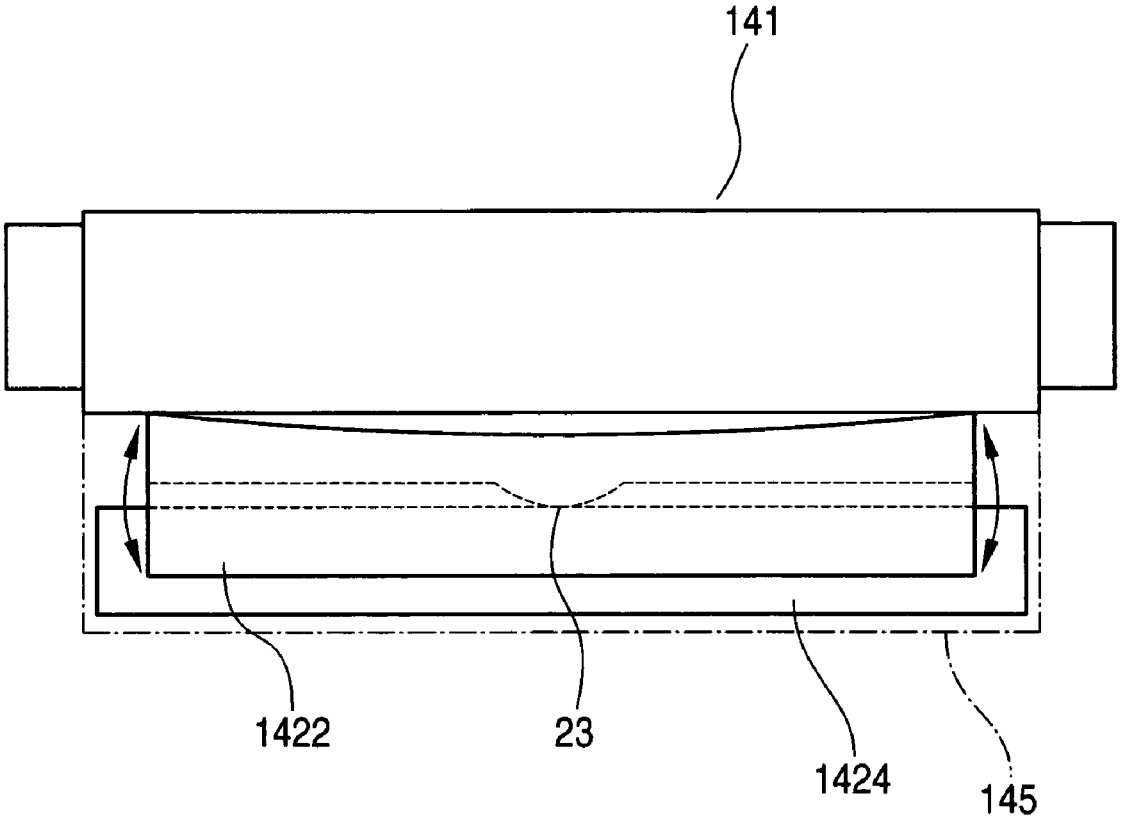
FIG. 5 is a view schematically showing a fixing device according to another embodiment of the invention.

Then, referring to FIGS. 3, 4 and 5, the embodiment of the invention will be further described. All the drawings are views as seen in a direction perpendicular to the rotation axis of the heating roller 141, schematically showing positional relations of the pressurizing pad 1422 and the stay 1424 with respect to the heating roller 141. FIG. 3 is a schematic view of the pressurizing pad 1422 before applying the pressure, and FIG. 4 is a schematic view of the pressurizing pad 1422 after having applied the pressure.

In FIG. 3, the pressurizing pad 1422 before applying the pressure has a concave shape in an axial direction (in a longitudinal direction) at a side of applying the pressure to the heating roller 141. This concave shape is preferably such that a dimensional difference between both end parts and a center part of the pressurizing pad 1422 is about 0.1 mm. It would be sufficient that the concave shape is provided on the pressurizing pad 1422 at a side opposed to the heating roller 141. It is configured that a projection 20 formed in a center part of the stay 1424 in a longitudinal direction thereof may come into contact with an inner side of the pressurizing pad 1422 at a side opposite to the heating roller 141. The pressurizing pad 1422 is supported so as to swing in a direction of arrow marks, around a contact point between the pressurizing pad 1422 and the projection 20 of the stay 1424 as a support point. When the pressurizing pad 1422 applies the pressure to the heating roller 141, the pressurizing pad 1422 will be deformed from the concave shape before applying the pressure, making both the end parts as fulcrums, and the support point in the center part as a functional point of the pressure. At a time point when the pressure has reached a predetermined pressurizing value, the side of the pressurizing pad 1422 adapted to come into contact with the heating roller 141 will be deformed from the concave shape to a flat shape so as to apply the pressure to the heating roller 141. Consequently, the pressure will be made uniform in the longitudinal direction. Further, because the pressurizing pad 1422 is supported at one point in the center part in the longitudinal direction so as to swing, strikes of the pressurizing pad 1422 against the heating roller 141 will be equalized at both ends in the longitudinal direction, which will also contribute to equalization of the pressure in the longitudinal direction.

In the embodiment of FIGS. 3 and 4, the stay 1424 is provided with the projection at a position opposed to the pressurizing pad 1422. Alternatively, in case where the pressurizing pad 1422 is provided with a projection at a position opposed to the stay 1424, making a contact point with the stay 1424 as the support point, substantially the same effect can be obtained. FIG. 5 is a view schematically showing the structure that a projection 23 is formed on the pressurizing pad 1422 so that the pressurizing pad 1422 can swing around a contact point with the stay 1424 as the support point.

According to the above described structures, it is possible to equalize the pressure against the heating roller in the longitudinal direction by the pressurizing pad 1422. Therefore, when printing has been conducted on the paper 16 by the printer 1, occurrence of poor picture quality due to difference in melting grade of the toner, and failure in conveyance of the paper 16 caused by wrinkles can be prevented.

What is claimed is:

1. An electro-photographic apparatus for conducting printing, the electro-photographic apparatus comprising:

a fixing device fixing an unfixed toner image on a surface of a recording medium onto the recording medium, the fixing device including:

a heating roller;

a mounting member;

a pressurizing member mounted on the mounting member; and an endless belt, wherein the pressurizing member is substantially formed in a concave shape in a longitudinal direction of the pressurizing member, wherein the mounting member has a projection in contact with the pressurizing member in a substantially center part in a longitudinal direction thereof, and wherein the electro-photographic apparatus is configured so that a pressure of the pressurizing member to be applied to the heating roller through the endless belt is substantially equalized by pressing the mounting member toward the heating roller while the pressurizing member is supported by the projection.

2. An electro-photographic apparatus for conducting printing, the electro-photographic apparatus comprising:

a fixing device fixing an unfixed toner image on a surface of a recording medium onto the recording medium, the fixing device including:

a heating roller;

a mounting member;

a pressurizing member mounted on the mounting member; and an endless belt, wherein the pressurizing member is substantially formed in a concave shape in a longitudinal direction of the pressurizing member, wherein the pressurizing member has a projection in contact with the mounting member in a substantially center part in a longitudinal direction thereof, and wherein the electro-photographic apparatus is configured so that a pressure of the pressurizing member to be applied to the heating roller through the endless belt is substantially equalized by pressing the mounting member toward the heating roller while the pressurizing member is supported by the projection.

3. An electro-photographic apparatus for conducting printing, the electro-photographic apparatus comprising:

a fixing device fixing an unfixed toner image on a surface of a recording medium onto the recording medium, the fixing device including:

a heating roller; and a pressurizing member mounted on a mounting member, wherein the pressurizing member includes an endless belt;

first, second and third pressurizing members that apply pressure to the heating roller through the endless belt; and a mounting member on which at least said second pressurizing member is mounted, and wherein the second pressurizing member is arranged between said first pressurizing member and said third pressuring member along a conveying direction of the recording medium, wherein the second pressurizing member has a concave shape in a longitudinal direction of the second pressurizing member, wherein the mounting member has a projection in a substantially center part in a longitudinal direction of the mounting member, and wherein the electro-photographic apparatus is configured so that the pressure of said second pressurizing member to be applied to said heating roller through said endless belt is substantially equalized by pressing the mounting member toward the heating roller while the second pressurizing member is supported by the projection.

* * * * *